United States Patent [19]

Marino et al.

[11] 4,326,649

[45] Apr. 27, 1982

[54] DUST COVER WITH ASSURANCE LUG

[75] Inventors: Samuel F. Marino, Oak Park; Daniel P. Hidding, Barrington, both of Ill.

[73] Assignee: Hunt-Wesson Foods, Inc., Fullerton, Calif.

[21] Appl. No.: 218,432

[22] Filed: Dec. 19, 1980

[51] Int. Cl.[3] ..... B67D 5/06; B65D 43/04

[52] U.S. Cl. ..... 222/182; 220/270; 220/281; 220/306

[58] Field of Search ..... 220/85 P, 270, 281, 220/306; 222/182, 153

[56] References Cited

U.S. PATENT DOCUMENTS

| | | | |
|---|---|---|---|
| 2,980,299 | 4/1961 | Smith | 222/182 |
| 3,102,658 | 9/1963 | Rosen | 220/270 |
| 3,480,184 | 11/1969 | Landis | 222/182 X |
| 3,927,796 | 12/1975 | Whitehouse | 220/281 |

*Primary Examiner*—George T. Hall

*Attorney, Agent, or Firm*—Fulwider, Patton, Rieber, Lee & Utecht

[57] ABSTRACT

A dust cover for an aerosol container includes a cup-shaped body placed over the dispensing valve of the container in an inverted position. To secure the cover, one or more fixed lugs project inwardly from the bottom edge of the body to engage a rim on the container. The cover is further secured by a release lug. A tab attaches the assurance lug to the body, the tab being permanently deformable to cause the assurance lug to be disengaged from the rim. The cover can then be removed by disengaging the release lug which is moved from its normal position by an actuator.

19 Claims, 8 Drawing Figures

PUSH UP
PRESS

DUST COVER WITH ASSURANCE LUG

FIELD OF THE INVENTION

The present invention relates to containers, and, more particularly, to removable dust covers for areosol containers and the like.

BACKGROUND OF THE INVENTION

Containers from which food and other consumables are dispensed through valves are generally provided with removable dust covers that enclose the valve openings. A variety of arrangements, such as a screw thread and elastically deformed lugs, are commonly known arrangements for holding the cover in place.

Aerosol containers of the type that are conventionally used for natural and artificial whipped cream, for example, usually have a rounded top in which the valve is disposed, the valve being surrounded by a rim. The valve can be actuated by displacing a sleave laterally to an off-center position, thereby causing the contents to be expelled through the sleave. To prevent inadvertent actuation of the valve and to maintain the contents in a sanitary condition, a plastic dust cover is placed over the sleave. Lugs on the bottom edge of the cover, of which there are usually two, resiliently engage the rim in a snap-on fashion, securing the cover to the container.

It is well known to provide an actuator whereby one of the lugs of the cover can be disengaged from the rim and the cover can be removed. An arrangement of this type is shown in U.S. Pat. No. 3,927,796 to Whitehouse issued on Dec. 23, 1975.

It has been found that, with a certain amount of skill and persistence, it is possible to remove a plastic dust cover of this type without leaving any indication that the cover has been tampered with. In fact, the elasticity of the plastic permits such a cover to be deformed sufficiently to disengage the lugs from the rim without using the actuator. It is then possible to force the cover back onto the rim in the original manner, perhaps after dispensing part of the contents of the container.

An objective of the present invention is to provide an improved dust cover that cannot be removed from the container without some permanent deformation. Thus, a consumer will know that if a cover is intact and has not been removed, the container carries the same complete contents with which it was originally filled. A further objective is to provide such a cover that does not add significantly to the cost of the article and is conveniently and easily used by the consumer. A still further objective is to provide such a cover that can be readily reused by the consumer after the container has been partially emptied.

SUMMARY OF THE INVENTION

The above objectives are accomplished, in accordance with the present invention, by a dust cover having a body with the shape of an inverted cup and a plurality of lugs that extend from the body to engage a rim on the top of a container. There is at least one fixed lug, a release lug movable by an actuator when it is desired to remove the cover, and an assurance lug connected to the body by a tab so that it initially engages the rim. The cover can be permanently deformed so that the assurance lug no longer engages the rim, thus permitting the actuator to disengage the release lug in a resilient manner so that the cover can be removed.

According to another aspect of the invention, a means is provided for shifting the cover laterally with respect to a force applied to the actuator, thereby causing a fixed lug to become disengaged from the rim. This can be accomplished by a cam surface on the top of the fixed lug, the surface preferably being tapered downwardly from the body sidewall toward the center of the cover.

In a preferred arrangement, there are two fixed lugs, one arranged diametrically opposite the release lug while the other is opposite the assurance lug.

A particularly advantageous arrangement employs a tab, divided from the body of the cover by slots, that connects the assurance lug to the body. A push-up lever that projects outwardly from the tab can be used to conveniently deform the cover when it is desired to disengage the assurance lug in preparation for removing the cover. Webs connecting the tab to the body are easily broken by the force applied to the lever by the thumb.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figures 1, 2, 3, 4, 5, 6, 7, 8:
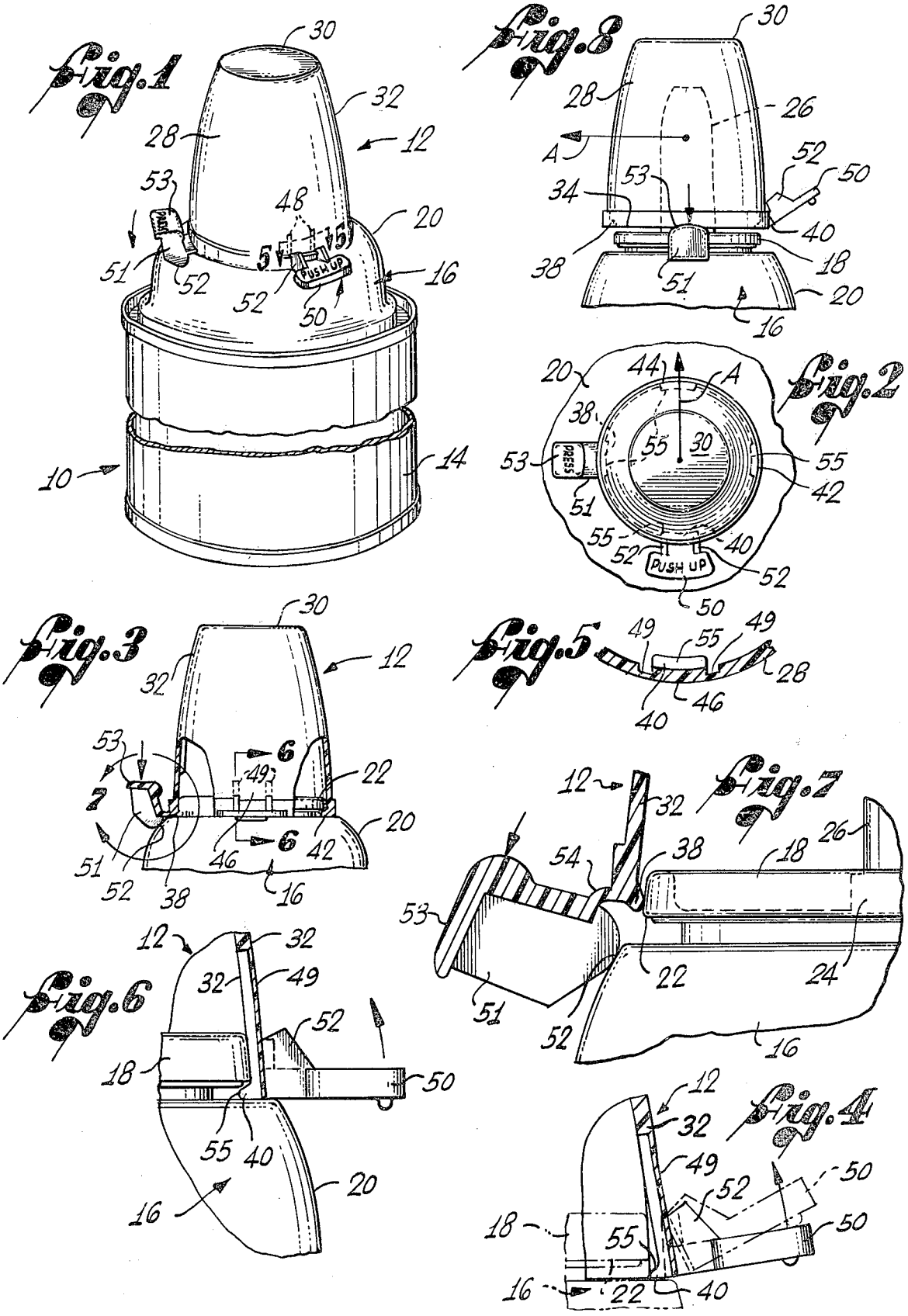
FIG. 1 is a perspective view of an aerosol container and dust cover combination constructed in accordance with the present invention.
FIG. 2 is a top view showing the cover and a fragmentary portion of the container.
FIG. 3 is a side elevation of the cover and part of the container, a portion of the cover being broken away to expose its engagement with the container.
FIG. 4 is an enlarged, fragmentary cross sectional view of the container that shows the assurance lug, the adjacent portion of the container being illustrated in phantom lines and the push-up lever being illustrated in phantom lines in its deformed position.
FIG. 5 is an enlarged, cross sectional view of a fragmentary portion of the cover, the view being taken along the line 5—5 of FIG. 1.
FIG. 6 is an enlarged fragmentary view of a portion of the cover and container, the cover being shown in cross section, as indicated by the line 6—6 of FIG. 3.
FIG. 7 is an enlarged fragmentary view of a portion of the cover and container, the view being taken as indicated by the arrow 7 in FIG. 3, the cover being shown in cross section and in the process of being disengaged from the container.
FIG. 8 is a side elevation of the cover and a fragmenting portion of the container, the cover being shown in the process of disengagement from the container.

An exemplary container 10 and a dust cover 12 that embody the present invention, shown in FIGS. 1 through 8, are of a type particularly suitable for dispensing whipped cream and other such toppings. The container 10 has a cylindrical side wall 14 closed by a top 16, with an annular valve receiving member 18 centered in the top. The portion of the top 16 that leads to the receiving member 18 forms a convex shoulder 20 terminating at a circular rim 22 that is formed by folding the outer edge of the receiving member over the top. Thus, the shoulder 20 surrounds the rim 22, which in turn encircles and positions a valve 24 (see FIG. 7).

The valve 24 is of well known construction and includes an upwardly projecting flexible plastic sleave 26. To dispense the contents of the container 10, the sleave 26 is simply displaced to a slightly off-center position, allowing the contents to be expelled through the sleave under pressure.

The cover 12 is a one-piece molded plastic article. It has a body 28 in the shape of an inverted cup, with a flat-top surface 30, and a sidewall 32 that sweeps outwardly to a circular bottom edge 34 at an open bottom end. Dimentionally, the bottom edge 34 slides over the rim 22 without deforming the cover 12.

Securing the cover 12 to the container 10 are four lugs, a release lug 38, an assurance lug 40, and two fixed lugs 42 and 44. The fixed lugs 42 and 44 are opposite the release lug 38 and the assurance lug 40, respectively, the four lugs being spaced apart at 90-degree intervals about the circular bottom edge 34 (as best shown in FIG. 2). Each of the four lugs 38, 40, 42 and 44 is in the form of a narrow lip that extends along an arcuate portion of the edge 34 and projects inwardly a short distance toward the center of the cover 12. The lugs 38, 40 42 and 44 thus fit under the rim 22, securing the cover 12 to the container 10.

When the cover 12 is first installed on the container 10, it is heated to permit it to stretch so that the lugs 38, 40, 42 and 44 can snap over the rim 22. Once in place and cooled to room temperature, however, the cover 12 does not have sufficient elasticity and flexibility to permit the lugs 38, 40, 42 and 44 to be disengaged from the rim 22 in a similar manner.

The assurance lug 40 and the segment of the bottom edge 34 from which it depends are part of a tab 46 that is separated from the main body 28 of the cover 12 by two parallel slots 48 extending vertically from the bottom edge 34. Preferably the slots 48 are not fully open. Instead, the tab 46 is joined to the adjacent sidewall 22 of the body 28 by a thin plastic web 49 (FIGS. 4, 5 and 6) that is easily broken.

Projecting outwardly and horizontally from the bottom of the tab 46, aliged with the bottom edge 34, is a push-up lever 50. Two small buttresses 52 prevent the lever 50 from bending relative to the tab 46.

To disengage the assurance lug 40 from the rim 22 in preparation for removing the cover 12, the lever 50 is manually pushed upwardly by the thumb so that the bottom of the tab 46 and the assurance lug are moved away from their initial positions (see FIG. 8). The tab 46 is thus permanently deformed and the assurance lug 40 remains in a disengaged position, as shown in FIG. 8 and in phantom lines in FIG. 4. Accordingly, the push-up lever 50 is used only once during the life of the cover 12.

Once the assurance lug 40 and its tab 46 have been deformed, the cover 12 can be removed from the container 10 by depressing an actuator 51 secured to the outside of the bottom edge 34 adjacent the release tab 38. The actuator 51 is a push-down lever with a downwardly projecting, rounded cam surface 52 that extends below the bottom edge 34, and a flat pressure surface 53 on top.

Using the thumb, one presses downwardly on the pressure surface 53, causing the actuator 51 to pivot relative to the body 28 upon bending, in a hinge-like manner, where it is secured to the body by a thin strip 54 of plastic (see FIG. 7). The plastic of which the actuator 51 and the body 28 are molded as a single and integral piece is sufficiently flexible and elastic to permit repeated pivotal movement of the actuator 51 without breaking the strip 54. Although some internal breakage and weakening of the plastic may occur, no permanent deformation takes place.

As the actuator 51 is depressed, the cam surface 52 rolls and slides on the shoulder 20 of the top 16. The outer end of the actuator 51 moves down while the inner end moves up, thus lifting the adjacent edge 34 and the release lug 38, prying the release lug from its normal position under the rim 22 (see FIGS. 7 and 8).

Each of the lugs 38, 40, 42 and 44 has a top cam surface 55 (best shown in FIGS. 2, 3 and 4) that is downwardly inclined from the sidewall 32 toward the center of the cover 12. An upward force applied to any of the lugs, therefore, tends to move the adjacent portion of the sidewall 32 and bottom edge 34 away from the rim 22. This type of interaction between the lugs 38, 40, 42 and 44 and the rim 22 helps to disengage the release lug 38 when the actuator 51 is depressed, but it is particularly significant in a different and more indirect manner with respect to the second fixed lug 44. Since this lug 44 is opposite the disengaged assurance lug 40, it is relatively free to shift the cover 12 laterally. Therefore, at the same time that the direct force applied to the actuator 51 is stretching the cover 12 along an axis extending from the release lug 38 to the first fixed lug 42, the second fixed lug 44 causes the cover 12 to move perpendicularly to that direct force (as indicated by arrows A in FIGS. 2 and 8) until the second fixed lug is disengaged from the rim 22. The cover 12 is then secured only by the first fixed lug 42.

As the actuator 51 pivots, the force applied by the thumb to its pressure surface 53 is redirected primarily toward the first fixed lug 42. The cover 12 thus moves away from the actuator 51 and the first fixed lug 42 is disengaged once the release lug 38 passes the top of the rim 22. The cover 12 is then completely released from the container 10 and can be removed.

With the assurance lug 40 in its disengaged position, the cover 12 can be readily reinstalled on the container 10. Modest pressure is applied to its top surface 30 causing the three remaining lugs 38, 42 and 44 to snap over the rim 22. Heating is not required.

Although the cover 12 will not be held as securely by only three lugs as it was originally by four, it will remain in place for normal use by the consumer. Once the cover 12 is back in place it will be apparent that it had been removed because the tab 46 will be bent outwardly and the webs 49 in the slots 48 will be broken (as last shown in FIG. 8).

The use of four lugs, including two fixed lugs 42 and 44, is preferred since it has been found that this arrangement renders it almost impossible to remove the cover 12 without heating so long as the assurance lug 40 remains in its undeformed, engaged position. Three lugs, including only one fixed lug (opposing both the release lug 42 and the assurance lug 44), are less effective and may require the use of a cover 12 having stiffer sidewalls 32.

It will be appreciated that the present invention gives the consumer a positive indication that the cover 12 has not been removed from the container 10. It provides a reliable indication, when the tab 46 and the webs 49 are intact and in their original positions, that no portion of the contents of the container 10 has been dispensed.

While a particular form of the invention has been illustrated and described, it will be apparent that various modifications can be made without departing from the spirit and scope of the invention.

We claim:

1. For a container having a top with a rim thereon, a dust cover that provides a positive indication that it has not been removed and that no portion of the contents of said container has been dispensed, said cover comprising:

a cup-shaped body to be placed on said top in an inverted position, said body having a circular bottom edge for engagement with said top;

a plurality of lugs to engage said rim on said top thereby retaining said cover on said container, there being an assurance lug, a release lug and at least one fixed lug;

actuator means integrally formed with said cover for disengaging said release lug from said rim without permanently deforming said cover; and tab means for connecting said assurance lug to said body and for disengaging said assurance lug from said rim upon permanent deformation thereof, said tab means being integrally formed with said body.

2. The dust cover of claim 1 wherein said tab means is defined by a pair of slots that extend upwardly from said edge.

3. The dust cover of claim 1 further comprising a break-away connection of said tab means to said body to prevent undesired movement of said assurance lug.

4. The dust cover of claim 3 further comprising a push-up lever integrally formed with said tab means and projecting outwardly therefrom to facilitate deformation of said tab means and disengagement of said assurance lug from said rim.

5. The dust cover of claim 1 wherein said fixed lug occupies a position on said rim diametrically opposed to said release tab.

6. For an aerosol container having a top with a valve therein surrounded by a rim, a dust cover that provides a positive indication that said cover has not been removed and that no portion of the contents of said container has been dispensed through said valve, said cover comprising:

a cup-shaped body to be placed over said valve in an inverted position, said body having a circular bottom edge for engagement with the top of said container;

a release lug for normally engaging said rim;

actuator means integrally formed with said cover for disengaging said release lug from said rim;

an assurance lug for initially engaging said rim;

tab means for connecting said assurance lug to said body and for disengaging said assurance lug from said rim upon permanent deformation thereof, said tab means being integrally formed with said body;

a first fixed lug positioned diametrically opposite said release lug with respect to said edge to engage said rim; and a second fixed lug positioned diametrically opposite said assurance lug with respect to said edge to engage said rim.

7. The dust cover of claim 6 further comprising cam surface means defined by said second fixed lug for interacting with said rim to urge said cover laterally with respect to a force applied by said actuator means, thereby disengaging said second fixed lug from said rim.

8. The dust cover of claim 7 wherein said cam surface means is formed by the top of said second fixed lug and is inclined downwardly from said body toward the center of said cover.

9. The dust cover of claim 8 wherein said tab means is defined by a pair of slots that extend upwardly from said edge.

10. The dust cover of claim 9 further comprising a push-up lever integrally formed with said tab means and projecting outwardly therefrom to facilitate deformation of said tab and disengagement of said assurance lug from said rim.

11. The dust cover of claim 8 wherein release lug, said assurance lug and said fixed lugs are spaced apart at 90 degree intervals on said edge.

12. For an aerosol container having a top with a dispensing valve therein surrounded by a rim, a dust cover that provides a positive indication that said cover has not been removed and that no portion of the contents of said container has been dispensed by actuation of said valve, said cover comprising:

a cup-shaped body to be placed over said valve in an inverted position, said body having a circular bottom edge for engagement with said top;

a release lug for normally engaging said rim;

actuator means integrally formed with said cover for disengaging said release lug from said rim;

an assurance lug for initially engaging said rim;

tab means for connecting said assurance lug to said body and for disengaging said assurance lug from said rim upon permanent deformation thereof, said tab means being integrally formed with said body;

a fixed lug integrally formed with said body and engaging said rim; and disengagement means for interacting with said rim to urge said cover laterally with respect to a force applied by said actuator means, thereby disengaging said second opposing lug from said rim.

13. The dust cover of claim 12 wherein said disengagement means comprises a cam surface formed on the top of said fixed lug.

14. The dust cover of claim 13 wherein said cam surface is inclined downwardly from said body toward the center of said cover.

15. The dust cover of claim 12 wherein said tab means is defined by a pair of slots that extend upwardly from said edge.

16. The dust cover of claim 15 further comprising a push-up lever integrally formed with said tab means and projecting outwardly therefrom adjacent to said edge to facilitate deformation of said tab means and disengagement of said assurance lug from said rim.

17. The combination of (1) a container having a top with a valve disposed therein through which the contents of said container can be dispensed and a rim surrounding said valve, and (2) a dust cover for said container, said cover comprising:

a cup-shaped body positioned over said valve in an inverted position, said body having a circular bottom edge engaging the top of said container;

a release lug normally engaging said rim;

actuator means for disengaging said release lug from said rim;

tab means for connecting said assurance lug to said body and for disengaging said assurance lug from said rim upon permanent deformation thereof, said tab means being integrally formed with said body;

a first fixed lug diametrically opposite said release lug and engaging said rim; and a second fixed lug diametrically opposite said assurance lug and engaging said rim.

18. The dust cover of claim 17 further comprising cam surface means defined by said second fixed lug for interacting with said rim to urge said cover laterally with respect to a force applied by said actuator means, thereby disengaging said second fixed lug from said rim.

19. The combination of (1) a container with a top having a rounded shoulder, and a valve disposed in said top through which the contents of said container can be dispensed, and a rim encircling said valve and surrounded by said shoulder, and (2) a dust cover for said container, said cover comprising:

a cup-shaped plastic body positioned over said valve in an inverted position, said body having a circular bottom edge engaging the top of said container;

a release lug projecting inwardly from said edge and normally engaging said rim;

actuator means integrally formed with said body for disengaging said release lug from said rim upon manual operation thereof;

an assurance lug projecting inwardly from said edge for initially engaging said rim;

tab means integrally formed with said body and said assurance lug for connecting said assurance lug to said body and for disengaging said assurance lug from said rim upon permanent deformation thereof;

a push-up lever integrally formed with said tab and projecting outwardly therefrom to facilitate deformation of said tab and disengagement of said assurance lug from said rim;

a first fixed lug projecting inwardly from said edge and diametrically opposed to said release lug for engaging said rim; and a second fixed lug projecting inwardly from said edge diametrically opposite said assurance lug and engaging said rim, said second fixed lug defining a cam surface that is inclined downwardly from said edge toward the said valve and engages said rim to urge said dust cover to move laterally thereby disengaging said second fixed lug from said rim upon operation of said actuator means.

* * * * *